US008607854B2

(12) United States Patent
Yang

(10) Patent No.: US 8,607,854 B2
(45) Date of Patent: Dec. 17, 2013

(54) FLUID HEAT TRANSFER DEVICE HAVING PLURAL COUNTER FLOW CIRCUITS WITH PERIODIC FLOW DIRECTION CHANGE THERETHROUGH

(76) Inventor: Tai-Her Yang, Dzan-Hwa (TW)

( * ) Notice: Subject to any disclaimer, the term of this patent is extended or adjusted under 35 U.S.C. 154(b) by 701 days.

(21) Appl. No.: 12/292,412

(22) Filed: Nov. 19, 2008

(65) Prior Publication Data

US 2010/0122804 A1 May 20, 2010

(51) Int. Cl.
*F28F 27/00* (2006.01)
*F28D 15/00* (2006.01)

(52) U.S. Cl.
USPC ..... 165/200; 165/272; 165/274; 165/104.19; 165/104.22; 165/104.33

(58) Field of Classification Search
USPC ..... 165/104.11, 104.14, 104.19, 104.21, 165/104.22, 104.26, 104.33, 200, 272, 273, 165/274
See application file for complete search history.

(56) References Cited

U.S. PATENT DOCUMENTS 4,171,622 A * 10/1979 Yamaguchi et al. ..... 62/324.1
4,173,865 A * 11/1979 Sawyer ..... 62/324.6
4,262,493 A * 4/1981 Lackey et al. ..... 62/324.6
4,483,156 A * 11/1984 Oudenhoven ..... 62/324.1
4,623,497 A * 11/1986 Waters ..... 165/104.21
4,680,001 A * 7/1987 Waters ..... 165/104.21
5,313,804 A * 5/1994 Kaye ..... 62/324.4
5,385,123 A * 1/1995 Evans ..... 123/41.21
5,461,876 A * 10/1995 Dressler ..... 62/238.7
5,695,004 A * 12/1997 Beckwith ..... 165/104.14
5,706,670 A * 1/1998 Voorhis ..... 62/324.6
5,758,514 A * 6/1998 Genung et al. ..... 62/324.4
5,813,244 A * 9/1998 Palmer ..... 62/324.6
6,065,289 A * 5/2000 Phillips ..... 60/525
6,077,158 A * 6/2000 Lake et al. ..... 454/70
6,118,099 A * 9/2000 Lake et al. ..... 62/323.1
6,138,466 A * 10/2000 Lake et al. ..... 62/238.7
6,745,830 B2 * 6/2004 Dinh ..... 165/104.25
6,889,754 B2 * 5/2005 Kroliczek et al. ..... 165/104.21
7,000,684 B2 * 2/2006 Kenny et al. ..... 165/104.21
7,004,240 B1 * 2/2006 Kroliczek et al. ..... 165/104.19
7,172,366 B1 * 2/2007 Bishop, Jr. ..... 405/37
7,484,374 B2 * 2/2009 Pham et al. ..... 62/324.1
7,549,461 B2 * 6/2009 Kroliczek et al. ..... 165/104.21
7,708,053 B2 * 5/2010 Kroliczek et al. ..... 165/104.21
7,721,793 B2 * 5/2010 Ippoushi et al. ..... 165/104.24
7,794,141 B2 * 9/2010 Perry et al. ..... 374/44
7,908,881 B2 * 3/2011 Kopko ..... 62/333
8,196,425 B2 * 6/2012 Popov ..... 62/389
8,297,343 B2 * 10/2012 Yang ..... 165/104.11

* cited by examiner

*Primary Examiner* — Ljiljana Ciric
(74) *Attorney, Agent, or Firm* — Bacon & Thomas, PLLC

(57) ABSTRACT

A fluid heat transfer device includes a multi-pipe arrangement for transporting fluids of temperature difference in counter flow directions on same end sides of a first transfer pipe and second transfer pipe having a parallel arrangement.

14 Claims, 7 Drawing Sheets

FLUID HEAT TRANSFER DEVICE HAVING PLURAL COUNTER FLOW CIRCUITS WITH PERIODIC FLOW DIRECTION CHANGE THERETHROUGH

BACKGROUND OF THE INVENTION (a) Field of the Invention

The present invention discloses a device having multiple piping configured to pass through thermal conducting fluid simultaneously in counter flow directions and allow periodic directional flow change simultaneously. First fluid piping of at least one circuit and a second fluid piping of at least a second circuit is configured in a parallel or quasi-parallel arrangement where the first fluid piping and the second fluid piping are configured to simultaneously transport thermal conducting fluids having a gaseous or liquid state gaseous to liquid state or liquid to gaseous state having a temperature difference into a passive heat dissipation or absorption receiving article or space in counter flow directions to produce a heat absorbing or dissipating function on the passive heat dissipation or absorption receiving article or space thereby forming a more uniform temperature distribution status. Additionally, a periodic fluid direction-change operative control device is used to control the periodic directional flow change by driving bidirectional fluid pumping devices to simultaneously periodically change the flow directions of the fluids inside the two counter flow pipings while still maintaining the transported fluid at mutual counter flow status.

(b) Description of the Prior Art

Conventional heat absorbing or dissipating application devices pass thermal conducting fluid through a heat absorbing or dissipating body, such as engine cooling water radiators, heat absorbing cooling energy discharge devices utilizing thermal conducting fluid, or heat dissipating warming energy discharge devices such as warming devices, heaters, or the warming energy transfer device, etc., in a fixed flow direction. Since the flow direction of the thermal conducting fluid is fixed, larger temperature difference is formed at each position on the heat absorbing or dissipating body of the thermal conducting fluid.

SUMMARY OF THE INVENTION

The present invention discloses the conventional application device that transports the thermal conducting fluid in a fixed flow direction passing through the heat absorbing or dissipating body for generating heat absorption or heat dissipation is improved by using a first fluid piping and second fluid piping having a parallel or quasi-parallel arrangement. The first and second fluid piping are configured to simultaneously transport the thermal conducting fluids that are in gaseous or liquid state, or changes from gaseous to liquid state or liquid to gaseous state to form a more uniform temperature distribution in the passive heat dissipation or absorption receiving article or space when transporting thermal conducting fluid to operate heat absorption or heat dissipation function, Additionally, a periodic fluid direction-change operative control device (250) issued to control a periodic flow directional change on the power source (300) that drives bidirectional fluid pumping device (123) to simultaneously periodically change the flow directions of the fluids inside the two counter flow piping while still maintaining the transported fluid at mutual counter flow status.

DESCRIPTION OF MAIN COMPONENT SYMBOLS

Figure 1:
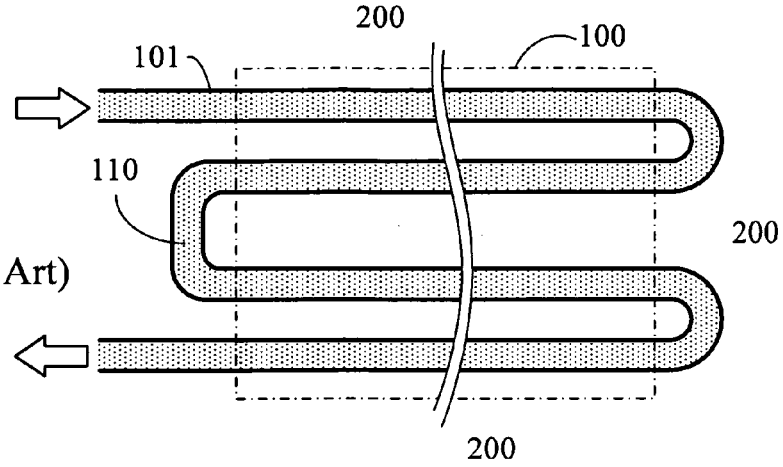
Fig. 1 (Prior Art)
FIG. 1 is a schematic view showing the main structure of the conventional heat absorbing or dissipating device being passed through by the thermal conducting fluid including the heat absorbing or dissipating gaseous or liquid state fluid, or gaseous to liquid state fluid, or liquid to gaseous fluid in fixed flow direction.

11: Temperature detecting device
100: Fluid heat transfer device
101: First fluid piping
102: Second fluid piping
105: Inlet manifold
106: Outlet manifold
110: Thermal conducting fluid
111: First fluid outlet piping
112: First fluid inlet piping
120, 120': Unidirectional fluid pump
121: Second fluid outlet piping
122: Second fluid inlet piping
123: Bidirectional fluid pumping device
124, 124': Bidirectional fluid pump
126, 126': Unidirectional valve
129, 129': Fluid valve
131, 132: Common fluid inlet/outlet port
200: Passively heat dissipation or absorption receiving solid, colloidal, liquid or gaseous state article or space
250: Periodic fluid direction-change operative control device
300: Power source

DETAILED DESCRIPTION OF THE PREFERRED EMBODIMENTS

FIG. 1 is a schematic view showing the main structure of the conventional heat absorbing or dissipating device for passing through a thermal conducting fluid in a fixed flow direction. As shown in FIG. 1, the conventional heat absorbing or dissipating device assembly has the thermal conducting fluid (110) passed through first fluid piping (101) in a fixed flow direction through the fluid heat transfer device (100). The fixed flow of the thermal conducting fluid can be used for 1) cooling or heating functions on the passive heat dissipating or absorbing receiving solid, colloidal, liquid or gaseous state article or space (200); or 2) reversely receiving the surrounding cooling or thermal energy of the warm energy fluid heat transfer device (100) for cooling or heating functions. The first function is often applied in engine cooling water radiators, heat absorbing cooling energy discharge devices utilizing thermal conducting fluid (110), or heat dissipating warming energy discharge devices utilizing thermal conducting fluid (110) such as warming devices, heaters, evaporators, condensers, or the cooling or warming energy transfer device, etc., while the second function 2) is often applied in cooling or warming energy transfer devices. In the application of the first function, the defects are that thermal conducting fluid (110) is input via the inlet of first fluid piping (101) at one end of the fluid heat transfer device (100) and output via another end of the fluid heat transfer device (100) thereby forming a larger temperature difference between of thermal conducting fluid at the inlet and outlet of first fluid piping (101). Similarly in the second function a larger temperature difference is formed between the thermal conducting fluid (110) at the inlet and outlet of the first fluid piping (101).

Figure 2:
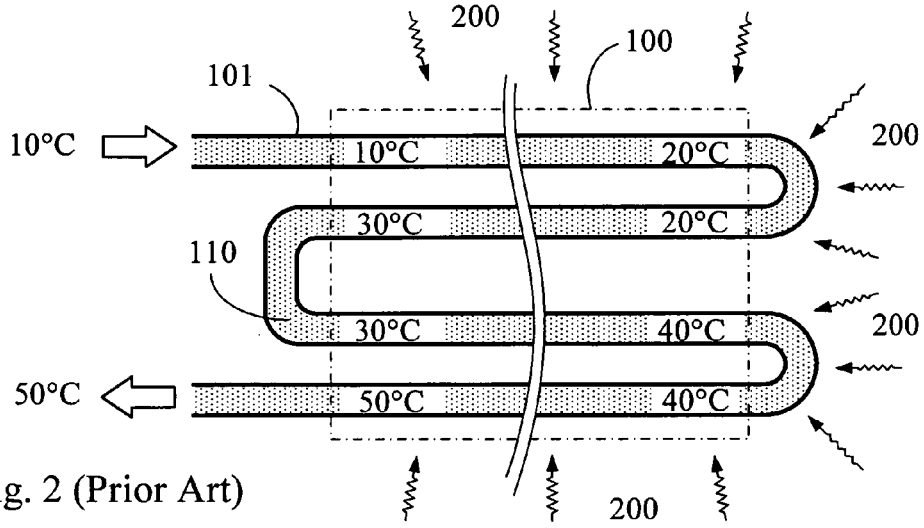
Fig. 2 (Prior Art)
FIG. 2 is a temperature difference distribution diagram of FIG. 1 being operated in heat absorbing cooling energy discharge device operational function.

FIG. 2 is a temperature difference distribution diagram of FIG. 1 during operation as a heat absorbing cooling energy discharge device. FIG. 2 shows the conventional unidirectional flow path layout of the thermal conducting fluid (110) in a fixed flow direction for releasing heat as shown in FIG. 1, where the distribution status of larger temperature difference is formed between the thermal conducting fluids (110) passing through first fluid piping (101) at the inlet and outlet of fluid heat transfer device (100).

Figure 3:
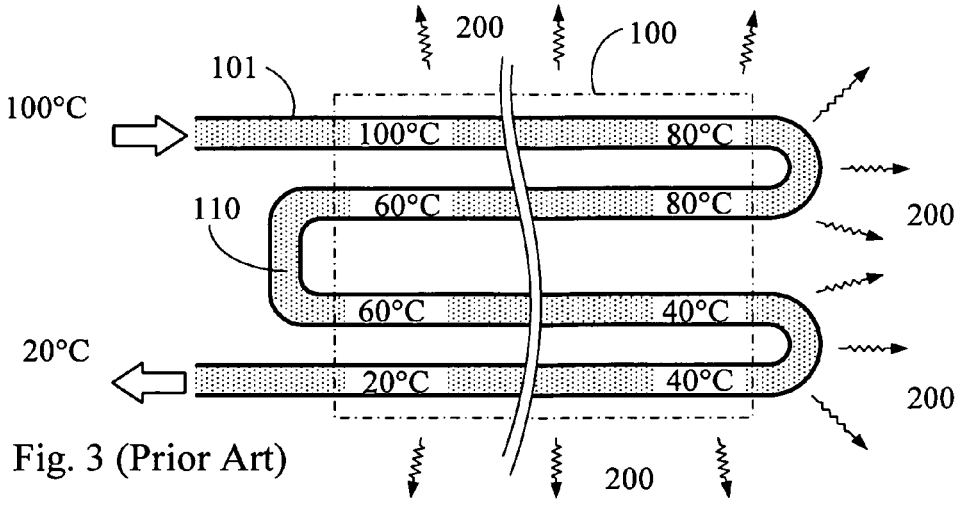
Fig. 3 (Prior Art)
FIG. 3 is a temperature difference distribution diagram of FIG. 1 being operated in heat dissipating warming energy discharge device function.

FIG. 3 is a temperature difference distribution diagram of FIG. 1 operated as a heat dissipating warming energy discharge device function. FIG. 3 shows that the thermal conducting fluid (110) in a fixed flow direction as shown in FIG. 1 operated as a conventional heat absorbing cooling energy discharge function in a unidirectional flow path thereby forming a larger temperature difference distribution status between the thermal conducting fluid (110) passing through first fluid piping (101) at the inlet and outlet of fluid heat transfer device (100).

Aiming to provide a more uniform temperature distribution, the present invention innovatively discloses a fluid heat transfer device having multiple counter flow circuits having a temperature difference with periodic flow directional change by passing thermal conducting fluid to produce heat absorbing or dissipating functions onto the article or space for passively receiving heat absorption or dissipation so as to form a more uniformed temperature distribution status on the heat absorbing or dissipating body.

Figure 4:
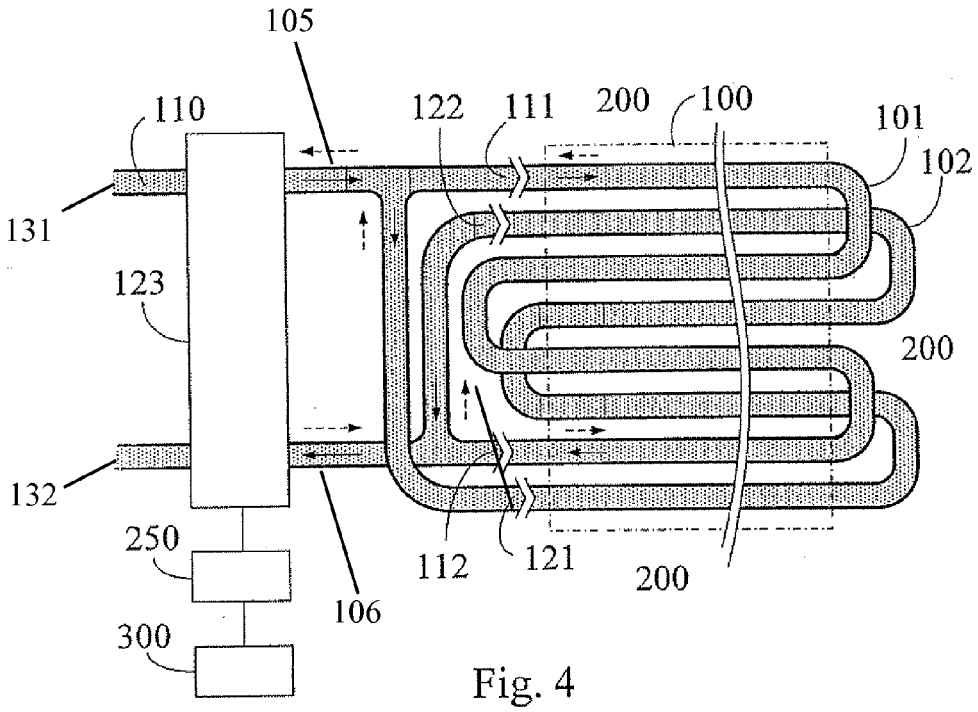
FIG. 4 is a schematic view showing the main structure of the fluid heat transfer device having multiple counter flow circuits of temperature difference with periodic flow directional change of the present invention being installed the bidirectional flow pumping device.

FIG. 4 is a schematic view showing the main structure of the fluid heat transfer device having multiple counter flow circuits of temperature difference with periodic flow directional change of the present invention. The main assembly structure of the fluid heat transfer device having multiple counter flow circuits of temperature difference with periodic flow directional change has at least one of the following structures:

A fluid heat transfer device (100) having a heat absorbing or dissipating structural body made of solid, colloidal, liquid or gaseous state thermal conductive material for receiving the thermal energy of thermal conducting fluid (110) inside a first fluid piping (101) and second fluid piping (102). This structure can perform a heat absorbing cooling energy discharge operating function or heat dissipating warming energy discharge operating function onto the passively heat dissipation or absorption receiving article or space (200). Additionally, there can be one or more of the fluid heat transfer device (100).

The first fluid piping (101) and the second fluid piping (102) are made of thermal conductive material and are used for reversely transporting the thermal conducting fluid (110) for transferring warming energy to fluid heat transfer device (100). The first fluid piping (101) and second fluid piping (102) are also arranged to form a first and second circuit within the heat absorbing or dissipating structural body.

An inlet manifold 105 has a first fluid outlet (111) and a second fluid outlet (121) arranged in parallel and further interconnected by a common fluid inlet/outlet port (131) of the inlet manifold 105 for receiving the inlet/outlet flow of thermal conducting fluid (110) being pumped by bidirectional fluid pumping device (123) from the fluid source. An outlet manifold (106) has a first fluid inlet (112) and a second fluid inlet (122) also arranged in parallel and further interconnected with common fluid inlet/outlet port (132) for receiving the inlet/outlet flow of thermal conducting fluid (110) being pumped by bidirectional fluid pumping device (123) from the fluid source.

The first fluid piping (101) and second fluid piping (102) are arranged to form the first and second circuits within the heat absorbing or dissipating body in a parallel or quasi-parallel arrangement in a planar or 3D shape. The first fluid outlet piping (111) and the second fluid inlet piping (122) are installed adjacent to each other at a position on the fluid heat transfer device (100), while the first fluid inlet piping (112) and the second fluid outlet piping port (121) are installed adjacent to each other at another position on the fluid heat transfer device (100). In other words, the first fluid outlet is arranged on an opposite end of a first side of the heat absorbing or dissipating body than the second fluid outlet of the inlet manifold and the first fluid inlet is arranged on an opposite side of the first side of the heat absorbing or dissipating body than the second fluid inlet of the outlet manifold. The first fluid piping (101) and second fluid piping (102) are installed on the fluid heat transfer device (100) to allow reversely transporting the thermal conducting fluid (110) in the two flow circuits to provide a more uniform temperature difference distribution in the fluid heat transfer device (100) so as to perform heat absorption or dissipation onto the passively heat dissipation or absorption receiving article or space (200). Furthermore, a bidirectional fluid pumping device (123) is installed that is capable of pumping in positive and reverse flow directions through a power source (300) that drives the bidirectional fluid pumping device (123) controlled by a periodic fluid direction-change operative control device (250) to periodically change the pumping flow direction of the fluid while maintaining the two flow circuits in different flow directions to pass through the first fluid piping (101) and the second fluid piping (102) in counter flow directions. In other words, the flow of the thermal conductive fluid through the first and second circuits is arranged so that the thermal conductive fluid is flowable in the heat absorbing or dissipating body such that the flow through the at least one first circuit is in one direction and the flow in the at least one second circuit is in a parallel and opposite direction to the one direction, and can be periodically changed using the bi-directional fluid pumping device (123) to flow in a second direction.

The bidirectional fluid pumping device (123) has the fluid pump capable of producing positive pressure to push fluid, or producing negative pressure to attract fluid for pumping the gaseous or liquid state fluid, wherein the bidirectional fluid pumping device (123) is driven by the power of the power source (300) and operatively controlled by the periodic fluid direction-change operative control device (250) to pump the fluid in different flow directions, while the flow directions of the two fluid circuits are periodically exchanged during operation.

The pumping includes: producing negative pressure for pumping fluids, or producing positive pressure for attracting fluids, or simultaneously producing negative pressure at the outlet port for pumping fluid and positive pressure at inlet port for auxiliary pumping fluid.

A power source (300) provides the operating power source and includes AC or DC city power system or standalone electric power supplying devices.

A periodic fluid direction-change operative control device (250): has electromechanical components, solid state electronic components, or microprocessors and related software and operative control interfaces to operatively control the bidirectional fluid pumping device (123) for periodically changing the flow directions of the two fluids passing through fluid heat transfer device (100) in different flow directions thereby operatively controlling the temperature difference distribution status between the fluid and fluid heat transfer device (100).

The timing for the periodic fluid directional change can be controlled by at least one of the following: 1) the pumping flow direction of the bidirectional fluid pumping device (123) is manually operatively controlled or 2) the direction-change time period is set by the periodic fluid direction-change operative control device (250) to operatively control the pumping flow direction of bidirectional fluid pumping device (123).

The bidirectional fluid pumping device (123) and the fluid heat transfer device (100) of the fluid heat transfer device having multiple counter flow circuits of temperature difference with periodic flow directional change of the present invention can be constructed as an integral structure or as separated structures.

Figure 5:
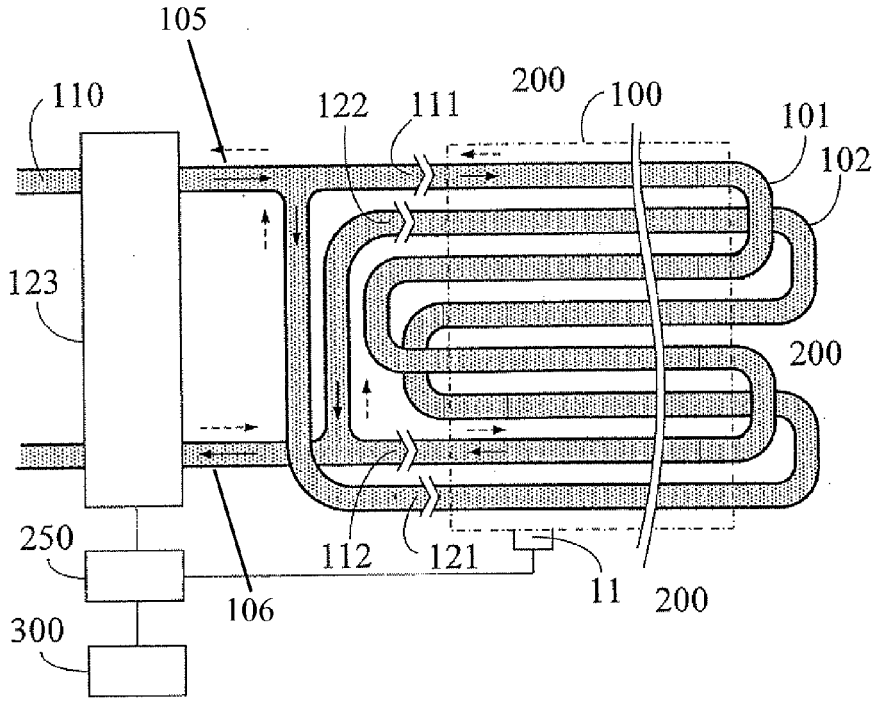
FIG. 5 is a main structural schematic view showing that the structure shown in FIG. 4 is installed with the temperature detecting device on one end thereof.

As shown in FIG. 5, for the fluid heat transfer device having multiple counter flow circuits of temperature difference with periodic flow directional change, a temperature detecting device (11) can be further optionally installed at one or more than one places on the fluid heat transfer device (100). The temperature detecting device (11) provides a detected temperature value as a reference for operatively controlling the periodic flow directional change timing of the fluid, as well as the direction of the bidirectional fluid pumping device (123) capable of positive and reverse flow directional pumping. The periodic fluid direction-change operative control device (250) can be used to operatively control the bidirectional fluid pumping to perform one or more of the following functional operations: 1) the pumping flow direction of the fluid is periodically changed, while the fluid of the two flow circuits are maintained in different flow directions to pass through the first fluid piping (101) and the second fluid piping (102) in counter flow directions; or 2) the flow rate of the pumping fluid is further operatively controlled.

FIG. 5 is a main structural schematic view showing that the structure shown in FIG. 4 is installed with the temperature detecting device on one end thereof.

Figure 6:
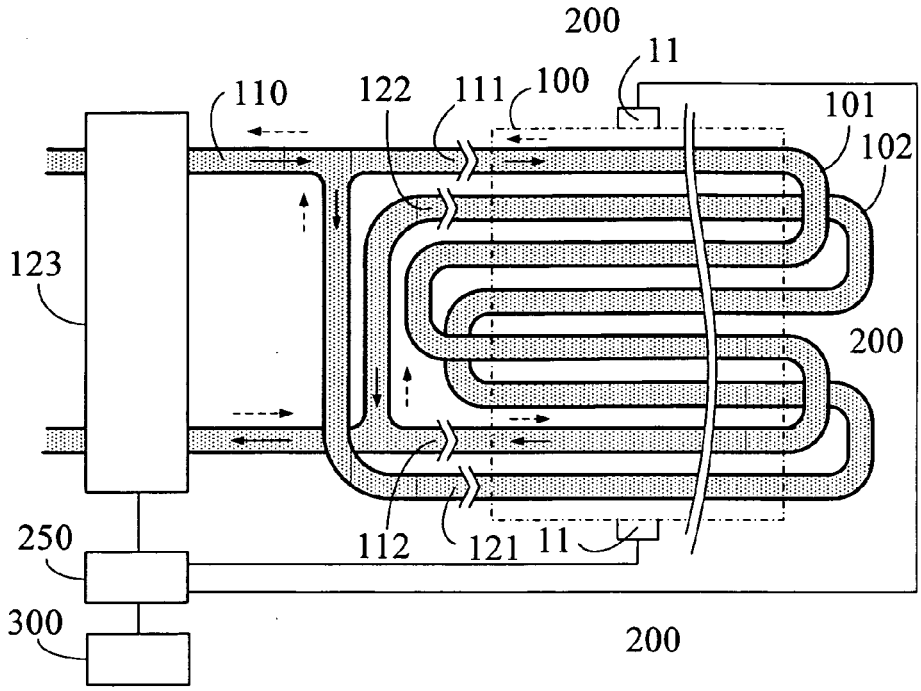
FIG. 6 is a main structural schematic view showing that the structure shown in FIG. 4 is installed with the temperature detecting devices on the two ends thereof.

FIG. 6 is a main structural schematic view showing that the structure shown in FIG. 4 is installed with the temperature detecting devices on the two ends thereof.

In these embodiments the timing of the periodic fluid directional change can be controlled as one of the following: 1) the pumping flow direction of the bidirectional fluid pumping device (123) is manually operatively controlled; or 2) the direction-change time period is set by periodic fluid direction-change operative control device (250) according to set time period or set time period by referring to temperature variation to operatively control the pumping flow direction of bidirectional fluid pumping device (123); or 3) the temperature value detected by temperature detecting device (11) installed on the fluid heat transfer device (100) is used as the reference for operatively controlling the timing of periodic flow directional change.

Figure 7:
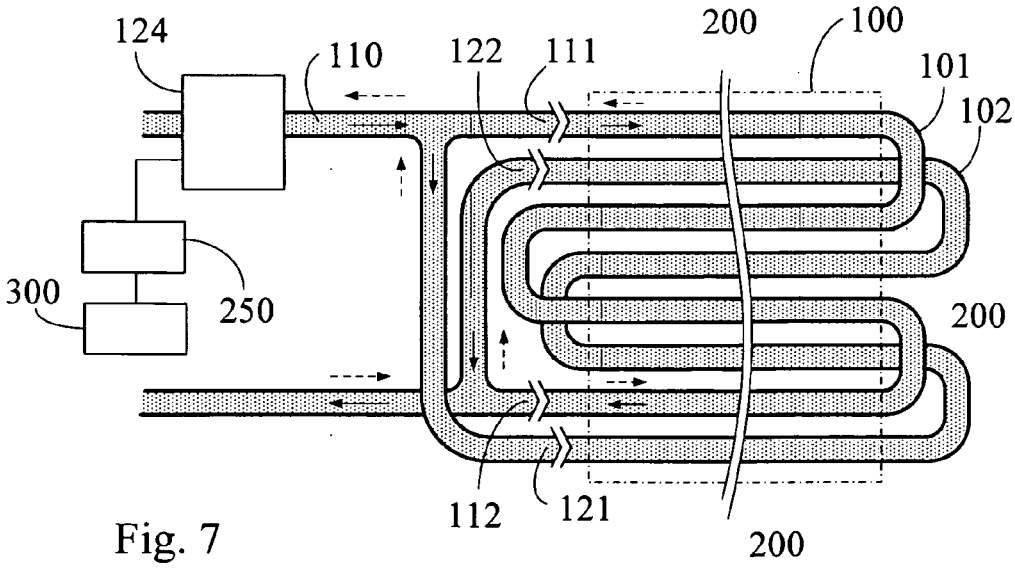
FIG. 7 is a schematic view of the embodiment of the present invention showing that at least one fluid pump capable of bidirectional fluid pumping is installed between either one end of the common fluid inlet/outlet ports of first fluid piping and second fluid piping and the fluid source.
Figure 8:
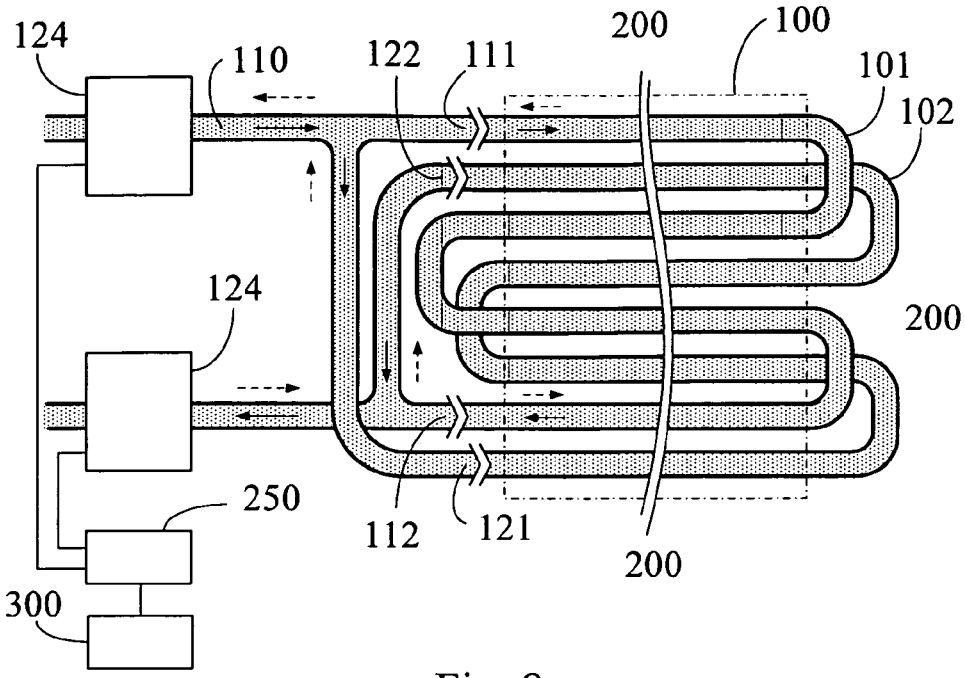
FIG. 8 is a schematic view of the embodiment showing that at least two fluid pumps capable of bidirectional fluid pumping constituting the bidirectional fluid pumping device are respectively installed between the fluid source and any one of the common fluid inlet/outlet ports at the two ends of the first fluid piping and second fluid piping.
Figure 9:
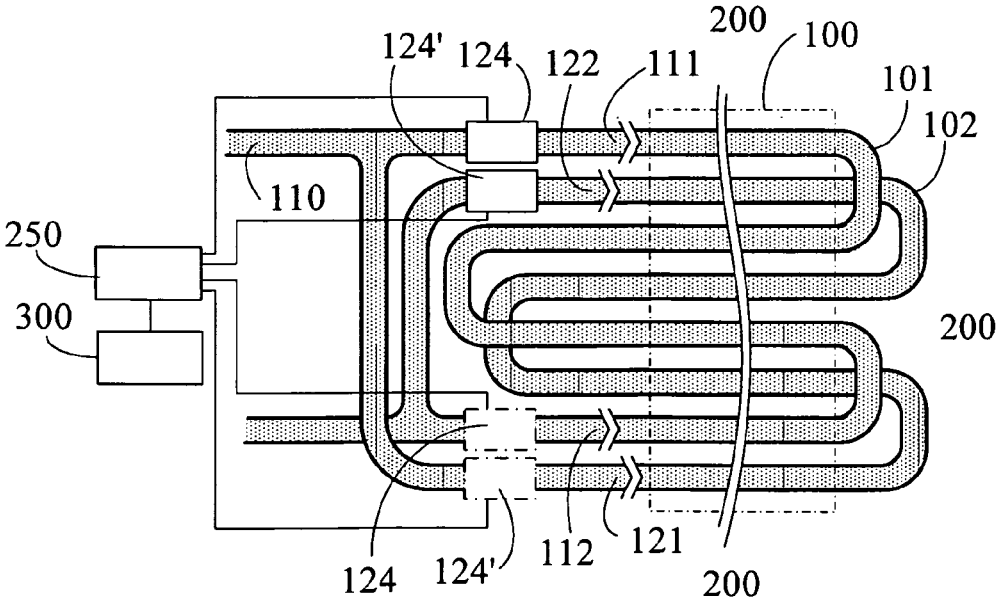
FIG. 9 is a schematic view of the embodiment of the present invention showing that at least two fluid pumps capable of bidirectional fluid pumping are respectively installed to the fluid inlet/outlet ports at one end of the first fluid piping and second fluid piping for periodically alternatively exchanging the fluid flow directions.
Figure 10:
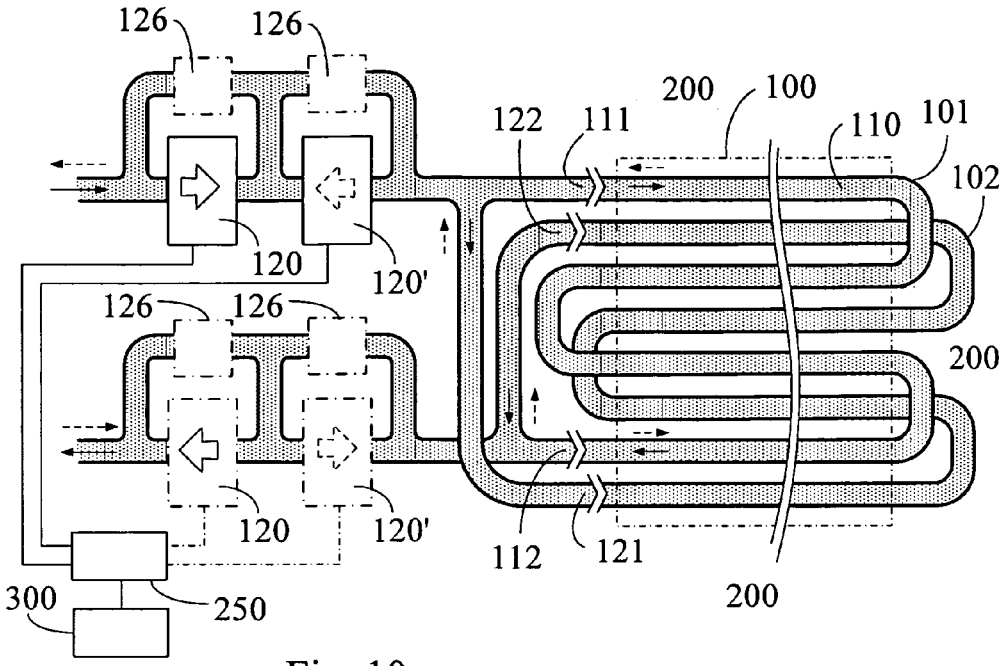
FIG. 10 is a schematic view of the embodiment showing that the present invention is installed with the bidirectional fluid pumping device constituted by at least two unidirectional fluid pumps in different flow directions being installed to both or either one of the two fluid inlet/outlet ports for external fluid input/output.

Based on aforesaid functional definitions, the embodiments of the bidirectional fluid pumping device (123) of the fluid heat transfer device having multiple counter flow circuits of temperature difference with periodic flow directional change of the present invention are optionally selected to include one or more of the following structures, including:

1. At least one fluid pump (124) capable of bidirectional fluid pumping used for the bidirectional fluid pumping device (123). The fluid pump (124) is installed between either one of the common fluid inlet/outlet ports of first fluid piping (101) and second fluid piping (102) of the fluid heat transfer device having multiple counter flow circuits of temperature difference with periodic flow directional change and the fluid source for operatively controlling the fluid pump (124) for periodic positive or reverse directional pumping to periodically change the flow directions of the fluids (FIG. 7 is a schematic view of the embodiment of the present invention showing that at least one fluid pump capable of bidirectional fluid pumping is installed between either one end of the common fluid inlet/outlet ports of first fluid piping and second fluid piping and the fluid source);
2. At least two fluid pumps (124) capable of bidirectional fluid pumping used for the bidirectional fluid pumping device (123). The fluid pumps are respectively installed between the fluid source and any one of the common fluid inlet/outlet ports of first fluid piping (101) and second fluid piping (102) for simultaneous auxiliary pumping in the same direction and for the operation of simultaneous periodic pumping flow directional change (FIG. 8 is a schematic view of the embodiment showing that at least two fluid pumps capable of bidirectional fluid pumping constituting the bidirectional fluid pumping device are respectively installed between the fluid source and any one of the common fluid inlet/outlet ports at the two ends of the first fluid piping and second fluid piping);
3. At least two fluid pumps (124) (124') capable of bidirectional fluid pumping installed to the respective fluid inlet/outlet ports at one end of the first fluid piping (101) and second fluid piping (102) of the fluid heat transfer device having multiple counter flow circuits of temperature difference with periodic flow directional change used for the bidirectional fluid pumping device (123). The bidirectional fluid pump (124) and bidirectional fluid pump (124') for pumping the fluid from the common fluid source in positive and reverse flow directions are operatively controlled by the periodic fluid direction-change operative control device (250) to periodically change the fluid flow directions. The respective fluid inlet/outlet ports at the other end of aforesaid first fluid piping (101) and second fluid piping (102) are further installed with at least two different bidirectional fluid pumps (124), (124') controlled by the periodic fluid direction-change operative control device (250) to periodically change the fluid flow directions while bidirectional fluid pumps of the same piping are driven in the same flow direction for auxiliary fluid pumping (FIG. 9 is a schematic view of the embodiment of the present invention showing that at least two fluid pumps capable of bidirectional fluid pumping are respectively installed to the fluid inlet/outlet ports at one end of the first fluid piping and second fluid piping for periodically alternatively exchanging the fluid flow directions);
4. At least two unidirectional fluid pumps (120) (120') in different flow directions connected in series used in the bidirectional fluid pumping device (123). The fluid pumps are installed between both or one of the two fluid inlet/outlet ports for fluid input/output of the fluid heat transfer device having multiple counter flow circuits of temperature difference with periodic flow directional change of the present invention. The pumping flow directions of the unidirectional fluid pump (120) pumps in a positive flow direction and unidirectional fluid pump (120') pumps in a reverse flow direction and are periodically alternately changed. If flow directions of the unidirectional fluid pumps (120) (120') are irreversible, then each unidirectional fluid pump is respectively connected in parallel with an unidirectional valve (126) in the reverse flow direction (FIG. 10 is a schematic view of the embodiment showing that the present invention is installed with the bidirectional fluid pumping device constituted by at least two unidirectional fluid pumps in different flow directions installed to both or either one of the two fluid inlet/outlet ports for external fluid input/output);
5. At least four unidirectional fluid pumps, two of them are unidirectional fluid pumps (120) for pumping in positive flow directions and two of them are unidirectional fluid pumps (120') for pumping in reverse flow directions, wherein one unidirectional fluid pump (120) pumps in positive flow direction and one unidirectional fluid pump (120') pumps in reverse flow direction being connected in series in the middle section of first fluid piping (101). If flow directions of the unidirectional fluid pumps (120) (120') are irreversible, then each unidirectional fluid pump is respectively connected in parallel with an unidirectional valve (126) in the reverse flow direction.

Figure 11:
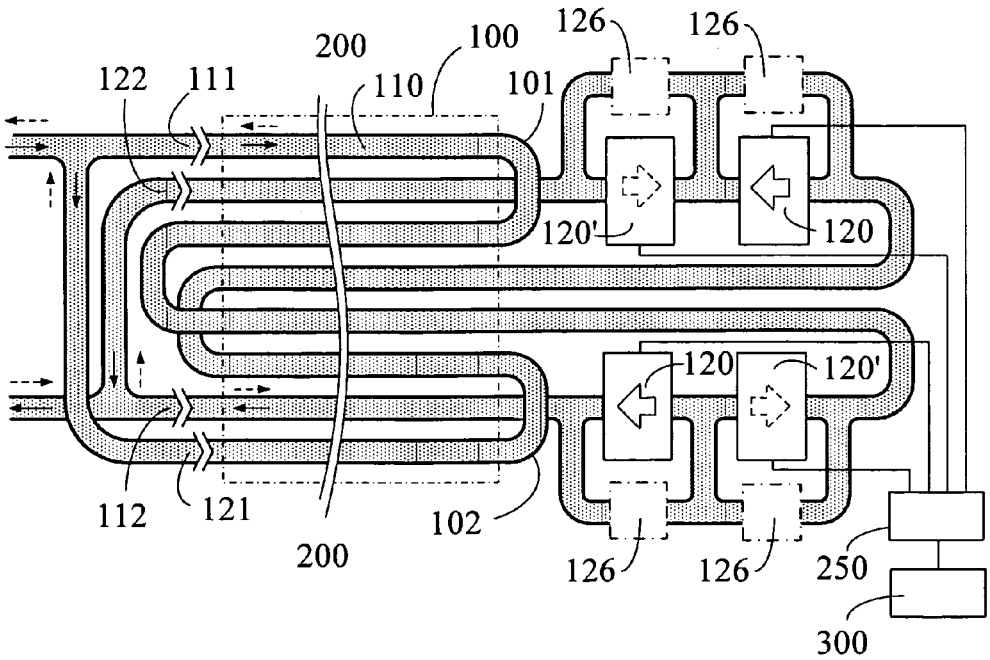
FIG. 11 is a schematic view of the embodiment showing that the present invention comprises at least four unidirectional fluid pumps: two are unidirectional fluid pumps in positive flow directions, and two are unidirectional fluid pumps in reverse flow directions, wherein one unidirectional fluid pump in positive flow direction and one unidirectional fluid pump in reverse flow direction being series connected are further series connected in the middle section of the first fluid piping, while the other unidirectional fluid pump in positive flow direction and the other unidirectional fluid pump in reverse flow direction being series connected are further series connected in the middle section of the second fluid piping.
Figure 12:
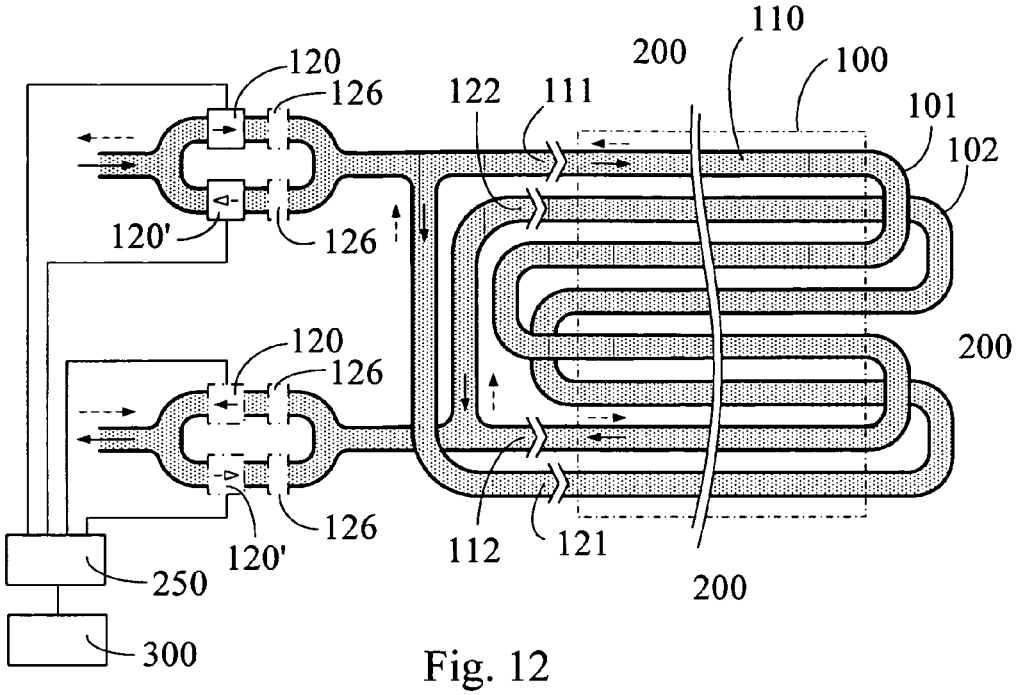
FIG. 12 is a schematic view of the embodiment showing that the present invention is installed with at least two unidirectional fluid pumps in different flow directions being parallel connected to constitute the bidirectional fluid pumping device in parallel connection are installed to both or either one of the two fluid inlet/outlet ports for external fluid input/output of the fluid heat transfer device having multiple counter flow circuits of temperature difference with periodic flow directional change.

The other unidirectional fluid pump (120) pumps in positive flow direction and the other unidirectional fluid pump (120') pumps in reverse flow direction and are connected in series in the middle section of second fluid piping (102). If flow directions of the unidirectional fluid pumps (120) (120') are irreversible, then each unidirectional fluid pump is respectively connected in parallel with an unidirectional valve (126) in the reverse flow direction. The unidirectional fluid pump (120) pumping in positive flow direction and the unidirectional fluid pump (120') pumping in reverse flow direction installed on the first fluid piping and the second fluid piping in different flow directions are operatively controlled to allow the unidirectional fluid pumps to be pumped in different flow directions and to periodically alternately change the pumping flow directions (FIG. 11 is a schematic view of the embodiment showing that the present invention comprises at least four unidirectional fluid pumps: two are unidirectional fluid pumps in positive flow directions, and two are unidirectional fluid pumps in reverse flow directions, wherein one unidirectional fluid pump in positive flow direction and one unidirectional fluid pump in reverse flow direction are connected in series are further connected in series in the middle section of the first fluid piping, while the other unidirectional fluid pump in positive flow direction and the other unidirectional fluid pump in reverse flow direction connected in series are further connected in series in the middle section of the second fluid piping).
6. At least two unidirectional fluid pumps (120) (120') used for pumping in different flow directions are connected in parallel to be used for the bidirectional fluid pumping device (123) and are installed to both or one of the two fluid inlet/outlet ports for fluid input/output of the fluid heat transfer device having multiple counter flow circuits with the periodic flow directional change of present invention. The unidirectional fluid pumps pumping in different flow directions are periodically operatively controlled for periodic flow directional pumping. If the structure of the unidirectional fluid pump has no anti-reverse flow function, then each unidirectional fluid pump is respectively forwardly connected in series with an unidirectional valve (126) and then connected in parallel to avoid anti-reverse flow (FIG. 12 is a schematic view of the embodiment showing that the present invention is installed with at least two unidirectional fluid pumps in different flow directions connected in parallel to constitute the bidirectional fluid pumping device in parallel connection are installed to both or either one of the two fluid inlet/outlet ports for external fluid input/output of the fluid heat transfer device having multiple counter flow circuits of temperature difference with periodic flow directional change).

7. At least four unidirectional fluid pumps, two of them are unidirectional fluid pumps (120) pumping in positive flow directions and two of them are unidirectional fluid pumps (120') pumping in reverse flow directions. One unidirectional fluid pump (120) pumping in positive flow direction and one unidirectional fluid pump (120') pumping in reverse flow direction are connected in parallel to be used for the bidirectional fluid pumping device (123) and are connected in the middle section of first fluid piping (101) If the structure of the unidirectional fluid pump has no anti-reverse flow function, then each unidirectional fluid pump is respectively series connected with an unidirectional valve (126) and then parallel connected to avoid reverse flow.

Figure 13:
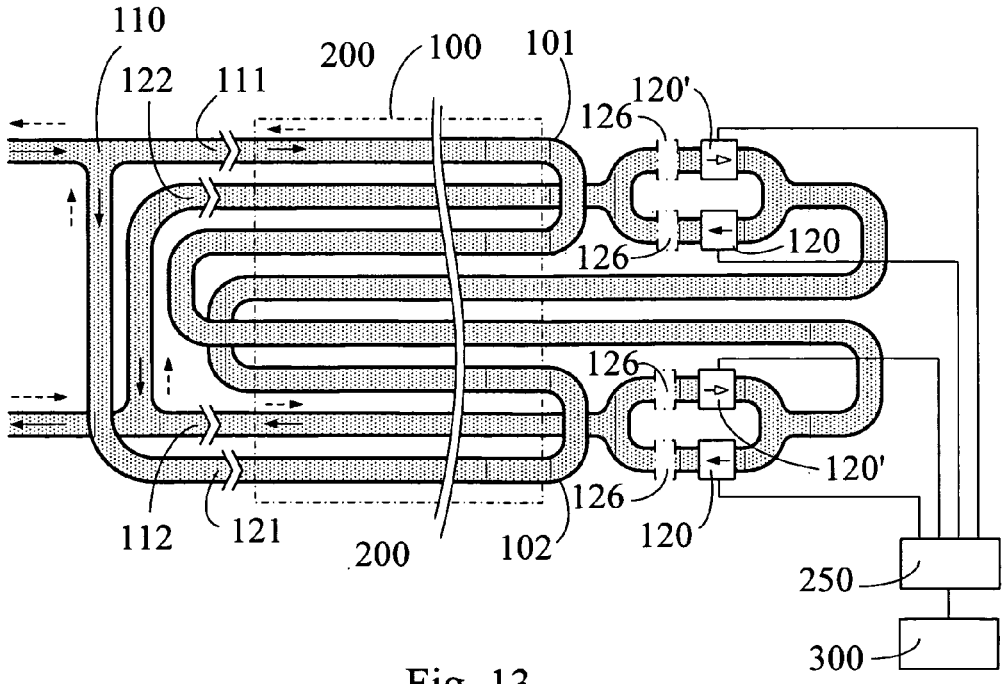
FIG. 13 is a schematic view of the embodiment showing that the present invention comprises at least four unidirectional fluid pumps: two are unidirectional fluid pumps in positive flow directions, and two are unidirectional fluid pumps in reverse flow directions, wherein one unidirectional fluid pump in positive flow direction and one unidirectional fluid pump in reverse flow direction being parallel connected are further series connected in the middle section of the first fluid piping, while the other unidirectional fluid pump in positive flow direction and the other unidirectional fluid pump in reverse flow direction being parallel connected are further series connected in the middle section of the second fluid piping.

The other unidirectional fluid pump (120) for pumping in positive flow direction and the other unidirectional fluid pump (120') for pumping in reverse flow direction are installed in the middle section of second fluid piping (102). If the structure of the unidirectional fluid pump has no anti-reverse flow function, then each unidirectional fluid pump is respectively connected in series with an unidirectional valve (126) and then further connected in parallel to avoid reverse flow. The unidirectional fluid pump (120) in positive flow direction and the unidirectional fluid pump (120') in reverse flow direction are installed on the first fluid piping (101) and second fluid piping (102) in different flow directions are operatively controlled to allow the unidirectional fluid pumps to be pumped in different flow directions and to periodically change the pumping flow directions (FIG. 13 is a schematic view of the embodiment showing that the present invention comprises at least four unidirectional fluid pumps: two are unidirectional fluid pumps in positive flow directions, and two are unidirectional fluid pumps in reverse flow directions, wherein one unidirectional fluid pump in positive flow direction and one unidirectional fluid pump in reverse flow direction connected in parallel are further connected in series in the middle section of the first fluid piping, while the other unidirectional fluid pump in positive flow direction and the other unidirectional fluid pump in reverse flow direction being parallel connected are further connected in series in the middle section of the second fluid piping).

Figure 14:
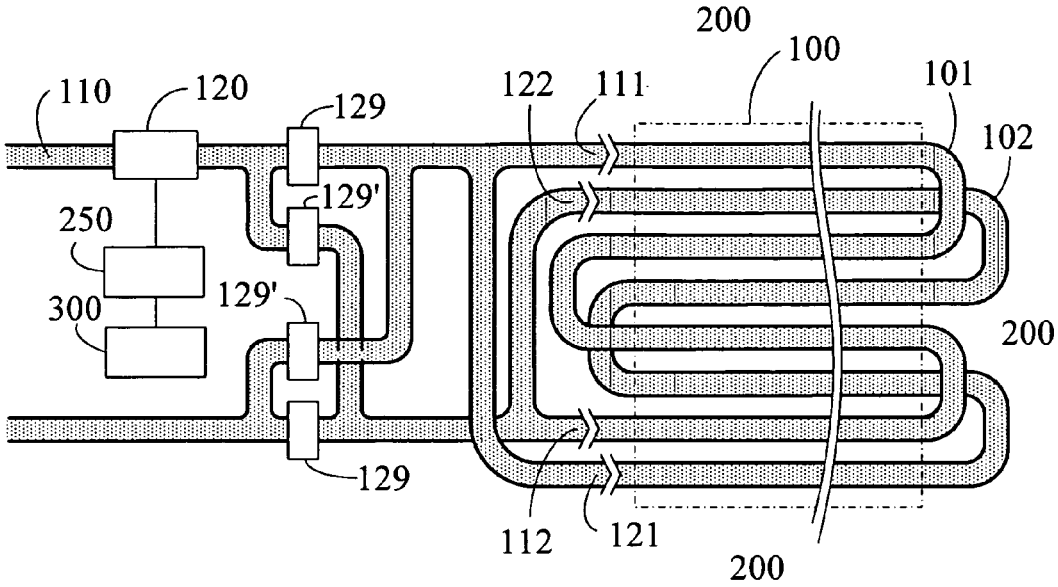
FIG. 14 is a schematic view of the embodiment showing that the present invention is installed with at least one unidirectional fluid pumping device and four fluid valves capable of switching operative control in bridge type assembly to the fluid inlet/outlet ports of the fluid heat transfer device having multiple counter flow circuits of temperature difference with periodic flow directional change for external fluid input/output.

8. The bidirectional fluid pumping device (123) constituted by at least one unidirectional fluid pump (120) and four fluid valves capable of switching operative control in bridge type assembly including two fluid valves (129) and two fluid valves (129') installed to the fluid ports for external fluid input/output of fluid heat transfer device having multiple counter flow circuits of temperature difference with periodic flow directional change of the present invention. During the operation of the unidirectional fluid pump, the two fluid valves (129) are operatively controlled to be opened or closed, while the other two fluid valves (129') are operatively controlled to be closed or opened thereby exchanging the fluid flow directions periodically (FIG. 14 is a schematic view of the embodiment showing that the present invention is installed with at least one unidirectional fluid pumping device and four fluid valves capable of switching operative control in bridge type assembly to the fluid inlet/outlet ports of the fluid heat transfer device having multiple counter flow circuits of temperature difference with periodic flow directional change for external fluid input/output).

In the applications of fluid heat transfer device having multiple counter flow circuits of temperature difference with periodic flow directional change of the present invention, and referring to application structural requirements and cost considerations, one or more one of the following design methods can be based on said operating principles:

The fluid heat transfer device (100) is combined as an assembled structure with at least one of the first fluid piping (101) and second fluid piping (102).

The fluid heat transfer device (100) is integrally combined with at least one of the first fluid piping (101) and second fluid piping (102).

At least one of the first fluid piping (101) and second fluid piping (102) performs heat absorption or dissipation onto the passively heat dissipation and absorption receiving solid, colloidal, liquid or gaseous state article or space (200) without installing the fluid heat transfer device (100).

The structural relationships between bidirectional fluid pumping device (123), first fluid piping (101), and second fluid piping (102) are that they are separately installed or integrally combined.

The structural relationships between bidirectional fluid pumping device (123), first fluid piping (101), second fluid piping (102), and fluid heat transfer device (100) are that all or at least two of them are integrally combined, or they are separately installed.

For the fluid heat transfer device having multiple counter flow circuits of temperature difference with periodic flow directional change of the present invention, the first fluid piping (101) and second fluid piping (102) are made from the integrally combined internal structure of fluid heat transfer device (100).

For the fluid heat transfer device having multiple counter flow circuits of temperature difference with periodic flow directional change of the present invention, the three including first fluid piping (101), second fluid piping (102) and fluid heat transfer device (100) have an assembled structure.

In the applications of the fluid heat transfer device having multiple counter flow circuits of temperature difference with periodic flow directional change of the present invention, the geometric shape of the application structure have one or more of the following:

For the fluid heat transfer device having multiple counter flow circuits of temperature difference with periodic flow directional change of the present invention, the fluid heat transfer device (100) combined with first fluid piping (101) and second fluid piping (102) has a structured body of a single plate, block or multi-fins shaped structure unit, or the structure unit assembled with fins, and has at least one structure unit as needed.

For the fluid heat transfer device having multiple counter flow circuits of temperature difference with periodic flow directional change of the present invention, the three including fluid heat transfer device (100), first fluid piping (101) and second fluid piping (102) made of solid, colloidal, liquid or gaseous state thermal conductive material can be made to various geometric shapes without changing principles.

For the fluid heat transfer device having multiple counter flow circuits of temperature difference with periodic flow directional change of the present invention, the first fluid piping (101) and second fluid piping (102) can be made to the common structure in various geometric shapes without changing principles.

For the fluid heat transfer device having multiple counter flow circuits of temperature difference with periodic flow directional change of the present invention, the thermal conducting fluid types and thermal conduction operating methods are one or more of the following:

For the fluid heat transfer device having multiple counter flow circuits of temperature difference with periodic flow directional change of the present invention, the thermal conducting fluid (110) is in a gaseous or liquid state, or gaseous to liquid state fluid, or liquid to gaseous state fluid.

For the fluid heat transfer device having multiple counter flow circuits of temperature difference with periodic flow directional change of the present invention, the thermal conducting fluid (110) is pumped, evaporated, or transported by cold and hot natural convection to pass through first fluid piping (101) and second fluid piping (102).

The fluid heat transfer device having multiple counter flow circuits of temperature difference with periodic flow directional change of the present invention is through heat transfer functions such as natural convention driven by cold to hot fluids in temperature difference, or forcedly pumping the fluid to produce convection, radiation, or thermal conduction to release warming or cooling energy onto the passively heat dissipation or absorption receiving solid, colloidal, liquid or gaseous state article or space (200) in fluid convection status; or it is through thermal conduction method to release warming or cooling energy onto the passively heat dissipation or absorption receiving solid, colloidal, liquid or gaseous state article or space (200).

For the fluid heat transfer device having multiple counter flow circuits of temperature difference with periodic flow directional change of the present invention, the thermal conduction fluid (110) passing through first fluid piping (101) and second fluid piping (102) is in closed loop circulation or is released as effluent.

The periodic fluid direction-change operative control device (250) in aforesaid fluid heat transfer device having multiple counter flow circuits of temperature difference with periodic flow directional change of present invention is equipped with electric motor, or controllable engine power, or mechanical or electric power generated or converted from other wind energy, thermal energy, temperature-difference energy, or solar energy for controlling various fluid pumps for driven, or controlling the operation timing of the fluid pumps or fluid valves, thereby changing the direction of the two circuits passing through the fluid heat transfer device (100) and further to operatively control partial or all regulations of rotational speed, flow rate, fluid pressure of various fluid pumps thereof.

The fluid heat transfer device having multiple counter flow circuits of temperature difference with periodic flow directional change of present invention can be applied for various heat absorbing or dissipating, or cooling heat transfer application devices, such as engine cooling water radiators, heat absorbing cooling energy discharge device using thermal conducting fluid, or heat dissipating warming energy discharge device using thermal conducting fluid such as warm energy, heater or thermal energy transfer devices for warming equipments, heating or cooling for ceilings, walls or floors of the buildings, cooling of photovoltaic panels, heating or cooling for electrical machine or power machineries, heat absorption and dissipation of various machine casings, heat pipe structures, structure casings, IC chips or semiconductor components, ventilation devices, or the heat absorption, heat dissipation or thermal energy transfer of information, audio or image devices, or heat dissipation of various lamp or LED devices, or the heat absorption of the evaporator or heat dissipation or thermal energy transfer of condensers of air conditioning devices, or thermal energy transfer of mechanical devices, or heat dissipation of frictional heat loss, or heat dissipation or thermal energy transfer of electric heater or other electric heating home appliances or cooking devices, or heat absorption or thermal energy transfer of flame heating stoves or cooking devices, or heat absorption, heat dissipation or thermal energy transfer of earth layer or water thermal energy, plant or housing building or building material or building spaces, heat absorbing or dissipation of water tower, or heat absorption, heat dissipation or thermal energy transfer of batteries of fuel cells, etc.

As well as applied for thermal energy transfer in home appliances, industrial products, electronic products, electrical machines or mechanical devices, power generation equipments, buildings, air conditioning devices, industrial equipments or industrial manufacturing process.

The invention claimed is:

1. A fluid heat transfer device comprising:

a heat exchanger having a first side, wherein the heat exchanger has an inlet manifold having a first and second outlet on opposite ends of the first side and an outlet manifold having a first and second inlet on opposite ends of the first side of the heat exchanger;

at least one first fluid piping coupled to the first outlet of the inlet manifold and to the first inlet of the outlet manifold to form at least one first circuit within the heat exchanger;

at least one second fluid piping coupled to the second outlet of the inlet manifold and to the second inlet of the outlet manifold to form at least one second circuit within the heat exchanger;

at least one bidirectional fluid pumping device coupled to one of the inlet manifold and the outlet manifold to pump a thermal conductive fluid in forward and reverse directions; and at least one periodic fluid direction-change operative control device that controls the at least one bidirectional fluid pumping device to periodically control a flow direction of the thermal conductive fluid that is originally pumped in a first flow direction to alternately flow in a second direction, wherein the at least one first and second circuits are configured in a way such that the thermal conductive fluid is flowable in the heat exchanger such that a flow through the at least one first circuit is in one flow direction and a flow in the at least one second direction is in a parallel and opposite flow direction to the one flow direction.

2. The fluid heat transfer device as claimed in claim 1, wherein the thermal conductive fluid is a fluid selected from the group consisting of a gas and liquid.

3. The fluid heat transfer device as claimed in claim 1, wherein the first outlet of the inlet manifold is configured in a way such that the first outlet is located in a first position adjacent to the second inlet of the outlet manifold and the second outlet of the inlet manifold is configured in a way such that the second outlet is located in a second position adjacent to the first inlet of the outlet manifold.

4. The fluid heat transfer device as claimed in claim 3, wherein the at least one periodic fluid direction-change operative control device is configured so that the flow direction of the thermal conductive fluid is manually controllable or settable based one a direction-change time period to periodically change the control of the flow direction.

5. The fluid heat transfer device as claimed in claim 3, wherein the bidirectional fluid pumping device has at least one fluid pump configured for bidirectional fluid pumping, wherein the at least one fluid pump is installed between either one of the first or second pipe and either one of the first or second sets of fluid ports.

6. The fluid heat transfer device as claimed in claim 3, wherein the bidirectional fluid pumping device comprises at least one fluid pump configured to pump bidirectionally and installed at each of the inlet manifold and the outlet manifold.

7. The fluid heat transfer device as claimed in claim 3, wherein the bidirectional fluid pumping device comprises four unidirectional fluid pumps installed at the first and second outlet of the inlet manifold and the first and second inlet of the outlet manifold, wherein two unidirectional fluid pumps pump in positive flow directions and two unidirectional fluid pumps pump in reverse flow directions, wherein one pump that pumps in positive flow directions is connected in series with one pump that pumps in reverse flow directions.

8. The fluid heat transfer device as claimed in claim 3, wherein the bidirectional fluid pumping device comprises at least one fluid pump operable to pump the thermally conductive fluid bidirectionally, said at least one pump installed at each of the first and second outlets of the inlet manifold to periodically change the thermal conductive fluid flow direction.

9. The fluid heat transfer device as claimed in claim 3, wherein the bidirectional fluid pumping device comprises at least one fluid pump operable to pump the thermally conductive fluid bidirectionally, said at least one pump installed at each of the first and second inlets of the outlet manifold to periodically change the thermal conductive fluid flow direction.

10. The fluid heat transfer device as claimed in claim 3, wherein the bidirectional fluid pumping device comprises two fluid pumps that pump in different flow directions connected in series and are installed at the inlet manifold or the outlet manifold, wherein the pumping flow directions are periodically changed to flow in opposite flow directions.

11. The fluid heat transfer device as claimed in claim 3, wherein the bidirectional fluid pumping device comprises two fluid pumps that pump in different flow directions connected in parallel and are installed at least at the inlet manifold or the outlet manifold, wherein the pumping flow directions are periodically changed to flow in reverse flow directions.

12. The fluid heat transfer device as claimed in claim 3, wherein the bidirectional fluid pumping device comprises four unidirectional fluid pumps, wherein two unidirectional fluid pumps pump in positive flow directions and two unidirectional fluid pumps pump in reverse flow directions, wherein one pump that pumps in positive flow directions is connected in parallel with one pump that pumps in reverse flow directions.

13. The fluid heat transfer device as claimed in claim 1, wherein the bidirectional fluid pumping device is configured as a positive displacement pump to push the thermal conductive fluid, or as a negative pressure pump to pull the thermal conductive fluid, or is configured to simultaneously produce a negative pressure at the outlet manifold for pumping the thermal conductive fluid and positive pressure at the inlet manifold for auxiliary pumping the thermal conductive fluid.

14. The fluid heat transfer device as claimed in claim 1, further comprising a temperature detecting device installed at one or more places on the heat exchanger, wherein the at least one periodic fluid direction-change operative control device is also configured to change the flow direction of the thermally conductive fluid using a detected temperature value.

* * * * *